United States Patent [19]

Mitchell

[11] Patent Number: 4,645,015

[45] Date of Patent: Feb. 24, 1987

[54] POWERED IMPACT INSTRUMENT

[76] Inventor: William C. Mitchell, 6440 N. Berkeley Cir., Moorpark, Calif. 93021

[21] Appl. No.: 775,377

[22] Filed: Sep. 12, 1985

[51] Int. Cl.[4] ..... B25D 11/06; B25D 17/08

[52] U.S. Cl. ..... 173/115; 173/119; 173/124; 279/1 SJ; 408/226

[58] Field of Search ..... 173/119, 120, 121, 115, 173/117, 124; 279/1 SG, 1 SJ; 408/226

[56] References Cited

U.S. PATENT DOCUMENTS

| | | | |
|---|---|---|---|
| 682,492 | 9/1901 | Payton | 173/103 |
| 2,298,845 | 10/1942 | Schmied | 173/120 |
| 2,898,893 | 8/1959 | Rohrer et al. | 173/121 |
| 3,074,155 | 1/1963 | Cootes et al. | 173/120 |
| 3,788,403 | 1/1974 | Mitchell | 173/119 |
| 4,006,787 | 2/1977 | Rumpp et al. | 279/1 SJ |
| 4,035,100 | 7/1977 | Kruger et al. | 408/226 |

*Primary Examiner*—Frank T. Yost

*Assistant Examiner*—Hien H. Phan

*Attorney, Agent, or Firm*—Keith D. Beecher

[57] ABSTRACT

A powered impact instrument comprising a spring-loaded head mounted at one end of a housing; a spring-loaded striker mounted within the housing; a block which slides reciprocally within the housing to which the striker is attached; a drive for the block which draws the block toward the rear of the housing; a sear which releasably couples the block to the drive to permit the block to draw the striker back against its spring, and which releases the block at a selected point of each stroke of the block so that the spring drives the striker against the head in order that the head may provide a high impacting force on the object being impacted thereby. An adjustable trigger is also provided by which the displacement of each stroke of the striker, and thus the impact by which it strikes the head, may be controlled. A unique coupler releasably attaches different tools to the head.

11 Claims, 10 Drawing Figures

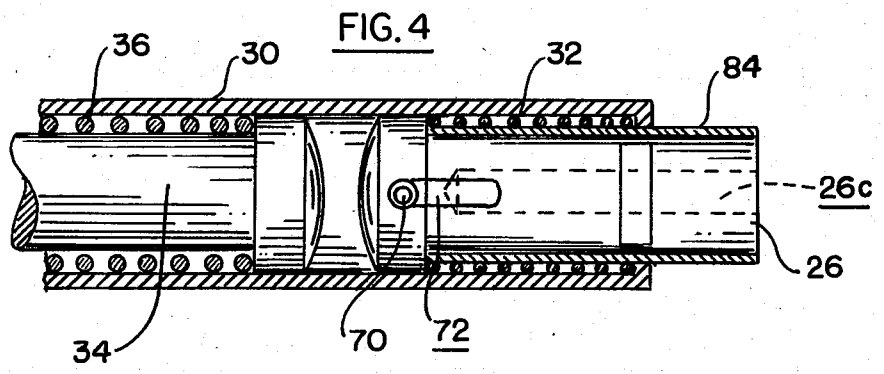
FIG. 4
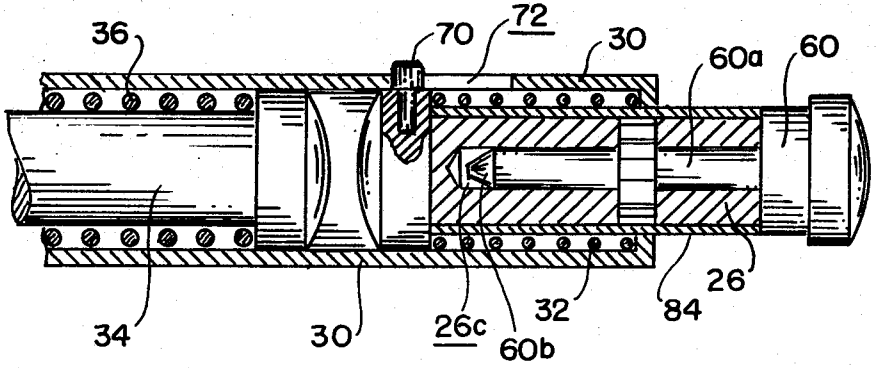
FIG. 5
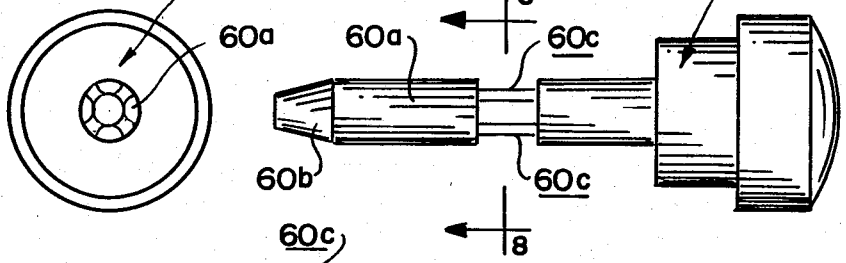
FIG. 7
FIG. 6
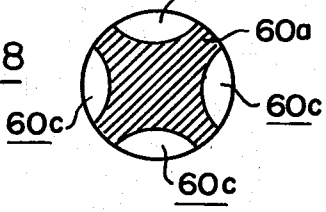
FIG. 8
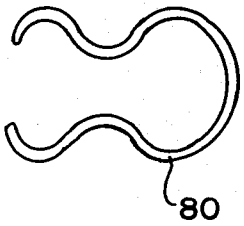
FIG. 9
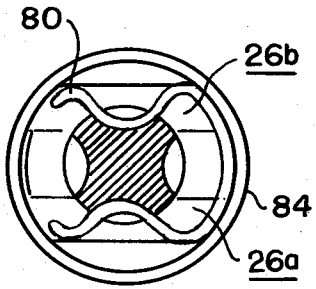
FIG. 10

POWERED IMPACT INSTRUMENT

BACKGROUND OF THE INVENTION

Power instruments are known in which a reciprocating striker acts upon a head so that the head may produce an impacting force. The head itself may constitute the impacting tool, as in the case of a powered hammer, or it may serve to receive other tools, such as a chisel, star drill, or the like.

In U.S. Pat. No. 1,310,574, for example, an automatic spring-actuated hammer is described in which a spring is periodically put under tension by means of an electric motor, and periodically released in order to impart to the hammer an impact pressure corresponding to the force stored up in the spring by its previous tensioning.

A powered impact instrument is also described in U.S. Pat. No. 3,788,403, which issued Jan. 29, 1974 to the present inventor. The impact instrument of the present invention is similar in some respects to the mechanism described in U.S. Pat. No. 3,788,403, and is one in which a head is struck repeatedly by a spring-loaded striker. The striker is periodically drawn back against the resilient pressure of a main spring and released against the head, so that sufficient impact force may be developed at the head to drive nails, or the like, without the need for an excessively large mechanism.

The impact instrument to be described, like the instrument described in U.S. Pat. No. 3,788,403, is advantageous in that the stroke displacement of the striker, and the resulting impact pressure of the head, may be controlled by the operator. In this way, at the beginning of an operation, the head may be driven at a relatively low impact force, to start a nail, for example. Then, the instrument may be controlled so that the head is driven at an increased impact force to drive the nail home. When the instrument is used to drive a star drill, chisel, or the like, as for example, in the sculpting of stone or wood, the magnitude of impact is readily controllable to suit the particular application.

BRIEF DESCRIPTION OF THE DRAWINGS

FIG. 4 is an enlarged detail view, partly in section, of another sub-assembly included in the instrument of FIGS. 1 and 2; FIG. 5 is a sectional view, similar to the view of FIG. 4, turned 90° on its longitudinal axis, and with a tool in place on the head;

FIG. 6 is an end view of a tool which may be removably mounted in the head of the instrument;

FIG. 7 is a side view of the tool of FIG. 6;

FIG. 8 is a sectional view of the tool taken along the lines 8—8 of FIG. 7;

FIG. 9 is a view of a tool-retaining spring clip; and

FIG. 10 is a further view of the clip of FIG. 9 in place on the head of the instrument.

DETAILED DESCRIPTION OF THE ILLUSTRATED EMBODIMENT

Figure 1:
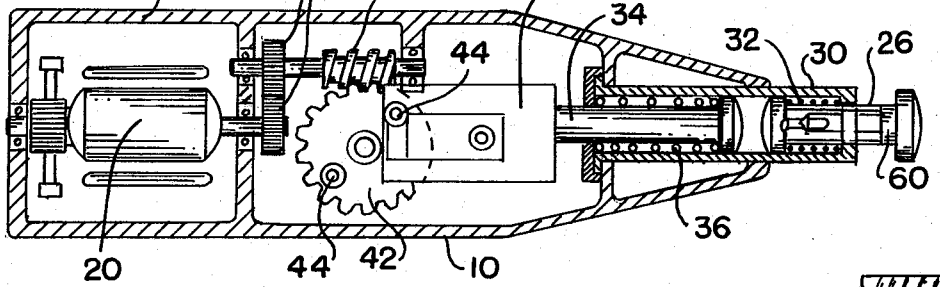
FIG. 1 is a sectional view of a powered impact instrument representing one embodiment of the invention.
Figure 2:
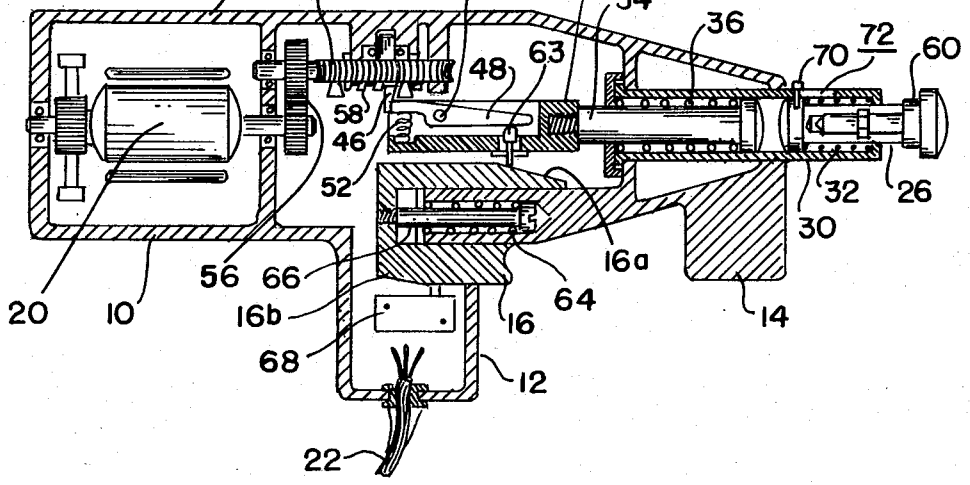
FIG. 2 is a side sectional view of the powered impact instrument of FIG. 1 turned 90° on its longitudinal axis.

The instrument shown in FIGS. 1 and 2 includes, for example, a housing 10. A pistol grip 12 is attached to the housing. A forward grip 14 is also attached to the housing. In the operation of the tool, it is grasped by the pistol grip 12 and by the forward grip 14, and is operated by pressing a trigger 16 in the pistol grip 12. It will be appreciated that the powered tool of the invention may be used by left or right handed people.

An electric motor 20 is attached to the rear end of housing 10 coaxial with the longitudinal axis of the tool. The motor is powered through an electric cable 22. If desired, the electric motor 20 may be replaced by an air operated motor, or other type of motor operating from other types of power sources.

A head 26 protrudes from the forward end of the housing 10. The head itself may be used as an impacter, as described above. Alternatively, the head may be configured, as shown, to receive an appropriate tool, as also mentioned above.

As shown in FIGS. 1, 2, 4 and 5, head 26 is resiliently biased inwardly into a barrel 30 by a coil spring 32. Barrel 30 is mounted in the forward end of housing 10, and it is coaxial with motor 20. A striker 34 is slidably mounted in barrel 30 in coaxial relationship with the head 26, and a coil spring 36 resiliently biases striker 34 to the right into an impact relationship with head 26, causing the head likewise to be moved to the right. Then, when the striker 34 is moved back to the left, head 26 again assumes its illustrated position in FIGS. 1 and 2 under the biasing pressure of its return spring 32.

It will be appreciated that the return spring 32 is a relatively weak spring, and its only function is to return the head 26 to its retracted position, when striker 34 is withdrawn. The main spring 36, on the other hand, is a strong spring, so that when the striker 34 is released, the main spring 36 drives it with high impact force against head 26.

As shown in FIGS. 1 and 2, a block 40 is slidably mounted in housing 10 for reciprocal movement in the housing along the common axis of the striker 34 and head 26. Striker 34 is threaded into the block 40, as shown. The block 40 is reciprocally moved along the axis in the housing 10 by means of a drive gear 42. Drive gear 42 is coupled to the block by means of one, two or more, eccentric drive pins 44. The pins 44 are mounted on the drive gear 42, and they engage the lip 46 of a sear 48 which is mounted on block 40. Then, as the drive gear 42 rotates, the block 40 and striker 34 are pulled back against the force of main spring 36.

The multiple drive pins 44 which are mounted on the drive gear 42 are free to rotate on their mountings. These pins, which may have tapered sides, engage the lip 46 of sear 48 as explained above, the sear being attached to block 40.

Figure 3:
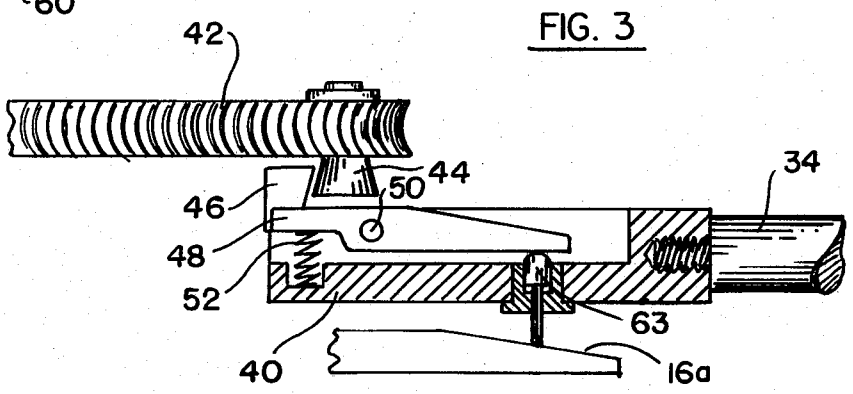
FIG. 3 is an enlarged view, partly in section, showing details of a certain sub-assembly included within the powered impact instrument of FIGS. 1 and 2.

As best shown in FIG. 3, the sear 48 is coupled to the block 40 by means of a shaft 50 which allows the sear to rotate to a limited degree. The sear is positioned to engage the drive pins 44 by means of a small compression spring 52 mounted in the block. As each drive pin 44 is moved into position by the rotating drive gear 42, it engages the sear lip 46, which also may be tapered, and causes the sear to pull the attached block 40 and striker 34 rearwardly, thus compressing the main spring 36, thereby transfering energy to the main spring from motor 20 through a gear train 56, a worm 58, drive gear 42, and the drive pin 44/sear 48 sub-assembly. Bevel gears, or other mechanisms, may also be used to make the 90° transition of rotary motion.

The sear 48 is subsequently released from the drive pins 44 by means of a sear pin 63 which lifts the opposite end of the sear, thus rotating the sear to cause it to be released from the drive pins. The block 40 and attached striker 34 are then impelled forwardly by the release of the energy stored in the main spring 36. The striker 34 impacts head 26 in which a tool 60 (FIGS. 6-8) such as a hammer, chisel, or the like, is mounted, causing the tool in turn to impact the workpiece.

The release of the sear mechanism by the upward motion of the sear pin 63 is in turn achieved by its lower end sliding up a ramp 16*a* as block 40 moves rearwardly. The ramp position, and thus the sear release position, is controlled by the position of trigger 16. The manually operated trigger 16, which tends to return to its normal position by means of a . trigger return spring 64 and pin 66, controls the degree of compression of the main spring 36 at which release occurs, and thus controls the magnitude of the impact. Accordingly, the operator can control the impact of the tool on the workpiece by positioning trigger 16.

An advantage of the multiple drive pins 44 engaging the sear 48 is that the wear of the pins and of the sear, may be reduced, thus extending the period before which these parts have to be replaced. This use of multiple drive pins, and correspondingly higher gear train speed reduction ratio, allows a correspondingly lower rotational rate of the drive gear 42. Wear of the worm on the teeth of the drive gear is also distributed, and the life of these parts is also extended.

The drive pins 44 are free to rotate in their mounting on the drive gear 42 which allows wear to be distributed around their circumferences, thus further extending their life. Because rotation of the drive pins allow them to roll up the lip 46 of the sear 48 as it is raised by the sear pin 63, release is facilitated by reduction of friction, improving the life of the sear and even further improving the life of the drive pins.

A second ramp 16*b* is provided at the lower rear end of the trigger 16, and this ramp is used to operate a switch 68. As the trigger 16 is moved back from its forward position, the plunger of switch 68 is actuated to apply power to the motor. As the trigger is released, and just before it reaches its most forward position, the switch plunger is released, interrupting power to the motor 20.

A number of impact instruments in the prior art have the undesirable feature of little or no damping or cushioning of the "equal and opposite reaction" impacting the operator. The impact tool of the present invention has the feature of an "anti-recoil" construction. The main spring 36 inherently provides this feature, since it tends to cushion the impact on the operator as it is released, and the person operating the tool feels nothing when the tool impacts the workpiece.

The design of some impact instruments of the prior art was such that moving parts caused precession of the tool. That is, the tool would tend to "walk" off the work as it was operated. The motor 20 of the impact instrument of the present invention has the axis of rotation of its rotor aligned with the travel of the striker and head. This minimizes the effects of gyroscopic precession of the rotor, which would otherwise tend to cause the tool to "walk". Front handle 14 is provided to steady the application of the impact tool to the workpiece, however, the operator need not fight the effects of precession. The location and shape of the front and rear handles 12 and 14 are such that the impact instrument of the invention may be used with equal ease by left- or right-handed persons.

The impact instrument of U.S. Pat. No. 4,788,403 incorporated an inner cylinder that was used to position the head in the proper rearward position so that it would be struck by the striker on its next impact when the instrument was operated without being held against the workpiece. This inner cylinder has been eliminated in the instrument of the present invention by the use of a pin 70 seated in the head 26 (FIGS. 4 and 5) that extends through a slot 72 in the barrel 30. The rearward end of slot 72 is located so that it positions the head for the next impact. The pin and slot arrangement also serves to prevent rotation of head 26.

A tool retention means utilizes a spring clip 80 (FIGS. 9 and 10) which passes through two transverse rectangular holes 26*a*, 26*b* through the head 26. A round hole 26*c* extends through the center of the head in which the shank 60*a* of the tool is inserted (FIG. 4). This round shank has a tapered end 60*b* (FIG. 7), and it has indentations 60*c* shaped to mate with portions of the spring clip 80. The holes in the head and the indentations in the shank of the tool are located such that, when the tool is fully inserted in the head, the spring clip 80 fits snugly into the indentations on the tool shank.

The edges of the spring clip prevent the tool 60 from flying forwardly when the head 26 is impacted by the striker 34 when the tool is not held against a workpiece; and the rotational detent effect of the spring 80 inhibits rotation of the tool 60 in the head 26, which might result when a chisel, for example, or other tool strikes an oblique surface. A sleeve 84 (FIGS. 4, 5 and 9) is placed around the head 26, whose purpose is to hold the tool retainer spring 80 in its correct position, and also to provide a smooth external surface for the head to slide within its return spring 32 and the end of barrel 30. A slot is cut around the head in the area of spring clip 80 in order to provide space necessary to contain the loop of the spring clip within the sleeve 84. Sleeve 84 may be retained in its proper position either by making it fit sufficiently tightly on the head, or by placing a flange on its rearward end, providing for it to be held in place by the return spring 32.

Insertion of the tool 60 into head 26 is made possible by means of the tapered end 60*b* of its shank. As the tool is inserted the taper forces the spring 80 outwardly to the full diameter of the shank 60*a* so that the tool 60 may be fully inserted. The tool may then be rotated to a selected one of several detented positions, the number of which depends on the number of indentations in the tool shank. Although more of less may be used, four of these indentations, as shown, appear to be a practical number.

Tool 60 may be removed from the head by rotating it to an angular position approximately midway between detents, thus spreading the spring clip 80 and allowing the tool to be removed. Easy insertion, angular positioning and removal of the tool are thus accomplished by the assembly described above, which also firmly retains the tool in the head against axial and angular movements.

The invention provides, therefore, an improved powered impact instrument in which a spring-positioned sear mechanism is engaged by one or more drive pins mounted on a drive gear, the sear mechanism being operated by a trigger-ramp to provide variable stroke and thus variable impact. The assembly is inherently "recoiless" because spring operation cushions release of the striker in the same way that a bow cushions the release of an arrow. Precessionless operation is achieved because the motor armature rotates on an axis which is aligned with the axis of movement of the striker and head. Multiple drive pins are used in the illustrated embodiment to operate the block/striker, thus distributing wear and increasing useful life. For the same reason, the drive pins are made to rotate freely against the sear as they pull the sear back against the force of the main spring.

A pin 70 projects into a slot 72 in the barrel of the instrument to prevent rotation of the head 26. Because the tool 60 is angularly confined in the head 26. its rotation is also prevented. This anti-rotation pin/slot arrangement also serves to limit rearward motion of the head 26 so that the head is returned by the return spring 32 to the proper position to be impacted by the next stroke of the striker 34.

The tool retaining assembly described above permits easy manual tool insertion and removal. The tapered end 60*b* of the tool shank is merely pushed into the head 26 to spread the retainer spring 80, and the tool 60 is then rotated to a desired detent position. The tool is axially retained in the head 26 preventing it from being ejected by impact when it is not held against the workpiece. The tool is also angularly retained in the head in one of several detent positions. The tool may be manually rotated from one detent position to another. The tool may be removed from the head by manually rotating it to a position approximately midway between two detent positions, thus spreading the retaining spring 80, and thereby permitting the tool 60 to be pulled free.

While a particular embodiment of the invention has been shown and described, modifications may be made. It is intended in the claims to cover all modifications which come within the spirit and scope of the invention.

I claim:

1. An automatic power impact instrument comprising: a housing; a head slidably mounted at one end of the housing; a first resilient means coupled to the housing and to the head for biasing the head inwardly with respect to the housing; a striker slidably mounted in the housing independently of said head in axial alignment with said head; a second resilient means coupled to said housing and to said striker for driving said striker toward said head to cause said striker to impact said head and drive said head against the biasing action of said first resilient means; drive means including a drive gear having at least one eccentric drive pin mounted thereon for drawing said striker back against the force of said second resilient means away from said head; a block attached to said striker and slidably mounted in said housing for reciprocal movement in said housing along the common axis of said head and said striker; a spring-loaded sear mounted on said block having a lip releasably engaging said eccentric pin for coupling said striker to said drive means; and manually operated trigger means coupled to said sear to release said sear from said eccentric pin at adjustable positions of said striker with respect to said head to control the impact force of said head.

2. The combination defined in claim 1, in which said drive means comprises a motor and transmission gear means coupling said motor to said drive gear.

3. The combination defined in claim 2, in which said drive gear has a plurality of drive pins mounted thereon to be successively engaged by the lip of said sear.

4. The combination defined in claim 3, in which said drive pins are mounted on said drive gear for rotation about the respective longitudinal axes thereof.

5. The combination defined in claim 2, in which said motor has a rotor axially aligned with said striker.

6. The combination defined in claim 1, in which said first and second resilient means comprise respectively first and second coil springs.

7. The combination defined in claim 1, and which includes a cylindrical barrel mounted on said housing in coaxial relationship with said striker and sand head and surrounding said striker and said head.

8. The combination defined in claim 7, and which includes a pin mounted on said head and extending through a slot in said barrel to hold said head against angular movement and to limit the axial displacement of said head by said first resilient means.

9. The combination defined in claim 7, in which said head has a central passage therein extending inwardly along the longitudinal axis from the forward end of said head, and which includes a tool having a central shank received in said passage for mounting said tool on said head.

10. The combination defined in claim 9, and which includes a spring clip mounted in said head and surrounding the shank of said tool for retaining said tool on said head.

11. The combination defined in claim 10, in which said head has holes therein for receiving said retaining clip, and said shank has detents therein engaged by said clip for holding said tool against longitudinal and angular movements with respect to said head.

* * * * *